United States Patent [19]

Kobler et al.

[11] 4,160,965

[45] Jul. 10, 1979

[54] POLARIZED MINIATURE RELAY

[75] Inventors: Ulrich Kobler; Horst Tamm, both of Munich, Fed. Rep. of Germany

[73] Assignee: Siemens Aktiengesellschaft, Berlin & Munich, Fed. Rep. of Germany

[21] Appl. No.: 815,829

[22] Filed: Jul. 14, 1977

[30] Foreign Application Priority Data

Jul. 16, 1976 [DE] Fed. Rep. of Germany ..... 2632126

[51] Int. Cl.[2] ..... H01H 51/22

[52] U.S. Cl. ..... 335/79; 335/81; 335/230

[58] Field of Search ..... 335/78, 79, 80, 81, 335/84, 85, 229, 230, 202

[56] References Cited

U.S. PATENT DOCUMENTS

| | | | |
|---|---|---|---|
| 3,522,564 | 8/1970 | Mori et al. | 335/78 X |
| 3,946,347 | 3/1976 | Sauer | 335/78 X |

*Primary Examiner*—George Harris

*Attorney, Agent, or Firm*—Hill, Van Santen, Steadman, Chiara & Simpson

[57] ABSTRACT

A polarized miniature relay where the armature and the armature activated electrical contacts are positioned interior of the coil winding with the contacts injection molded in contact carriers and the contact carriers and armature preassemblable onto a bar magnet forming a single unit inserted into the coil interior.

20 Claims, 8 Drawing Figures

POLARIZED MINIATURE RELAY

BACKGROUND OF THE INVENTION

1. Field of the Invention

The invention relates to a polarized miniature relay with a switching space located inside the body of a coil winding and in which space a rotary armature assembly is disposed to operate at least one spring contact assembly.

2. Prior Art

By arranging the armature assembly and the working air gap of a relay within the relay coil tube, as opposed to disposing the armature outside the body of the coil, the iron cross-section, or iron mass, can be reduced while preserving the same sensitivity for the relay. In addition a magnet and electric contact system which is disposed within the coil tube can be sealed easily. In a known relay of this kind such as that shown in German Auslegeschrift No. 2,318,812 or British Pat. No. 1,456,861 the body of the coil is made of two parts which are connected together in a form-locking or assembly securing manner. The interior switching space is thus sealed by this construction. However, in such prior art constructions, the armature must be mounted in both halves of the coil body. Therefore, the magnet system does not become operational until the part of the body of the coil which forms the cover is placed in position. At that time the switching space is closed, i.e. the contacts are no longer accessible for adjustment. In addition, in this prior type relay the permanent magnets unless a permanently magnetized armature is used, are disposed at the ends of the body of the coil. Thus for reasons of symmetry at least two permanent magnets have to be used, which makes magnetic balancing of the relay more difficult.

Further, British specification No. 1,246,177 (German Auslegeschrift No. 1,639,417) discloses an unpolarized multicontact relay in which the armature and the contacts are housed in the body of the coil which forms a protective tube. The reciprocal alignment of the magnetic parts on the one hand and the contact springs on the other is effected in this type of construction by a contact carrier which extends longitudinally of and roughly in the middle of the coil while simultaneously serving as a carrier for the pole shoes. The contact carrier has apertures through which operating elements attached to the armature engage. As the contact carrier is made of an insulating material, it must have a large cross-section to have the required strength. Consequently it takes up an unreasonably large amount of space inside the coil tube. Otherwise, the said specification makes no suggestion as to the formation of a polarized relay of the kind named at the beginning.

SUMMARY OF THE INVENTION

The object of the invention is to create such a polarized miniature relay with a highly sensitive response which by virture the simplicity of its design insures that production costs are low and that the assembly can be sealed satisfactorily. In addition the symmetry of the forces and response values must be easily adjustable by magnetic means when the relay is finished.

In the case of a relay of the kind named at the start, this object is achieved in accordance with the invention in that a bar shaped permanent magnet is disposed in the switching space parallel with the axis of the coil. The bar magnet can be inserted in the coil tube axially and has pole plates securely fixed to both its ends. Thus the bar magnet forms a rigid fixing rail for one or more contact carriers (i.e. parts which carry electric contact equipped members such as the contact carrying spring or a contact tipped metal pin) and for the rotary armature.

In a relay in accordance with this invention the carrying and linking element in the switching space is the permanent magnet with the pole plates secured to it. This means that the available space is fully utilized, and the parts which belong together by function are locatable in the right relative position without any additional carrying element. Since the armature is not attached to the body of the coil but is, instead, mounted directly or indirectly on the permanent magnet, the magnet system together with the contact springs can be made as a separate unit on its own. This unit can then be adjusted as necessary separate from the coil and thereafter inserted in the coil, which can also made separately. Apart from this, this arrangement of the magnet system, with the bar magnet passing therethrough means that magnetization and balancing can be carried out in the assembled state.

On a continuous three-pole bar magnet the two pole plates and perhaps a flux plate disposed on the center pole can be lined up together in one plane. Expediently the pole plates lie flat on the magnet in each case and are connected to the latter by welding or brazing for example. In one advantageous embodiment the permanent magnet is made of a magnetic alloy with cobalt, chromium and iron together with a small percentage of silicon. This magnetic material is distinguished by high mechanical strength and excellent welding properties and is thus particularly well suited for the present application as a carrier for the entire magnet and contact system.

Expediently contact carriers are held on the permanent magnet or the pole plates in a locked-in-place manner. Depending upon the production method, individual contact carriers made of insulating material can be provided with a greater or lesser number of injection molded contact springs. In one advantageous embodiment provision is made for the contact springs to be disposed in one plane and to be anchored in a contact carrier. Two such contact carriers are then insertable one in the other in a self-locking locked-in-place manner enclosing an end of the permanent magnet or of a pole plate attached thereto. These contact carriers are, in a preferred embodiment shown expediently held together by means of pegs which are molded on one contact carrier and can be distorted after being introduced into holes in a second contact carrier. In one embodiment of the invention provision is also made for one of the contact carriers to be formed with a molded projection on either side of the permanent magnet and to serve as mounting for the armature. In this construction the armature can be formed with bearing pegs which are hingably attachable to the elastically distortable contact carrier projections.

The bar magnet and the contact unit affixed to the magnet is inserted in the coil tube axially. Expediently the contact pins all project from the contact carriers roughly parallel with the coil axis so that they do not impede insertion and can thereafter be bent to the plane of connection as required, after the contact unit has been inserted in the coil body. The contact carriers are preferably sized to the opening in the body of the coil so that after insertion they seal off the switching space at both ends of the coil. The pole plates extend out of the coil tube through the contact carriers and are bent at right angles in one advantageous embodiment of the invention so that they lie flat against a protective cap which is placed over the coil and function therewith as soft magnets serving to return the flux. If needed, the protective cap can also be filled with casting compound.

It is therefore a principle object of this invention to provide a miniature polarized relay where the electrical contacts and armature are positioned interior of the winding and where the combination sub-unit of the contacts, armature and permanent magnet can be assembled together as a separate unit for later insertion into the coil.

It is another specific object of this invention to provide a miniaturized electrical relay utilizing a bar magnet which carries a switch assembly including a movable armature and which assembly is insertable into the interior of a coil winding.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
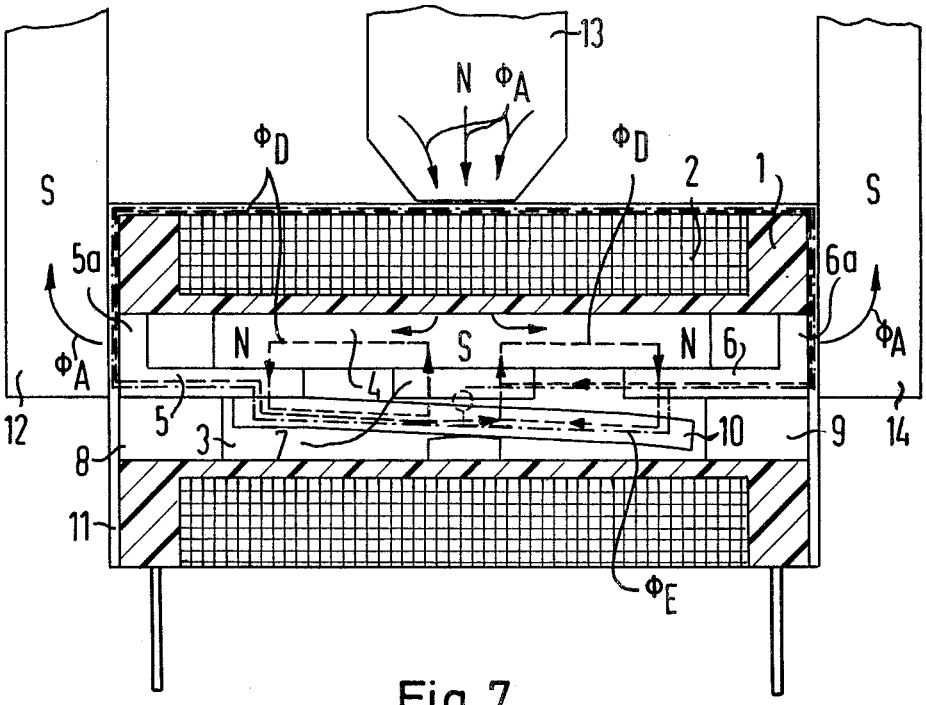
FIG. 1 diagrammatically illustrates a relay system constructed in accordance with the invention showing it in position to be magnetized in an external jig.

FIG. 1 shows a polarized relay in accordance with the invention with the magnet system emphasized in the illustration (the contact springs are not shown). The coil body 1 carries coil winding 2 in the usual way and forms a switching space 3 inside the coil body cavity. In this space 3 a bar shaped three-pole magnetized permanent magnet 4 is disposed parallel with the coil axis and carries pole plates 5 and 6 respectively at both ends. These pole plates 5 and 6 are aligned on the flat side of the permanent magnet together with a flux plate 7 provided in front of the middle pole and are connected to the permanent magnet by welding or brazing for instance. Thus the permanent magnet 4 with the pole plates 5 and 6 simultaneously forms a supporting fixing rail on which the contact carriers 8 and 9, which are incompletely shown (schematically), and the armature 10 are lined up and secured. Thus the magnet and contact system can be assembled separately on its own so that it can be adjusted outside the body of the coil and then inserted in the switching space 3. The contact carriers 8 and 9 are so matched with the opening of the coil tube that they combine with the pole plates 5 and 6 to seal off the switching space 3 at both ends of the body of the coil.

A ferromagnetic protective cap 11 serves as a magnetic flux return path at the same time. The pole plates 5 and 6 are also bent at right angles at their ends 5*a* and 6*a* so that they lie flat against the side of the protective cap 11.

The function of the magnet system is already known from prior systems. The armature is switched by overlaying the permanent magnet flux $\Phi_D$ and the excitation flux $\Phi_E$. One particular advantage in the present application of this magnet system is the fact that, finally, any magnetizing and balancing of the system can be done once the unit is fitted in the body of the coil. To this end magnetizing yokes 12, 13 and 14 are fitted to the relay from the outside in the manner shown and the permanent magnet 4 is magnetized with the magnetic flux $\phi_A$. Balancing or tuning to a desired response voltage is carried out with two air coils in place of the magnetizing yoke 12 and 14 as will be apparent to those skilled in the art.

Figure 2:
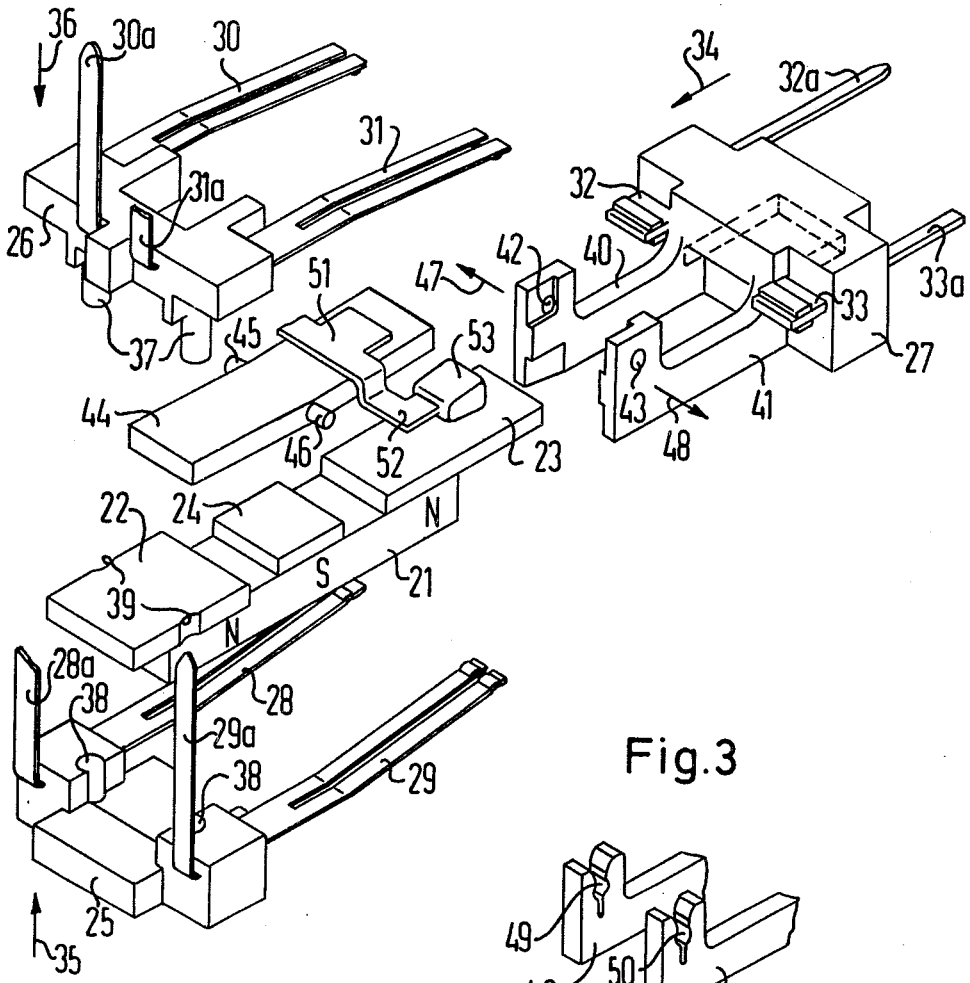
FIG. 2 is an exploded parts view of the contact, armature and magnet sub-assembly of the construction of FIG. 1.

FIG. 2 shows an exploded view of the parts of the magnet system and the contact set for a relay in accordance with the invention. Once again as in the diagrammatic representation of FIG. 1, the carrying part is a permanent bar magnet 21 on a flat side of which two yoke plates or pole plates 22 and 23 and a flux plate 24 are lined up and secured. At the ends of the carrier formed in this way contact carriers 25, 26 and 27 are fitted in a structure locking manner. In the present example the relay has two sets of reversing springs. The contact elements, lying in one plate in each case are injected into an insulator block forming the contact carrier. The contact springs 28 and 29, 30 and 31 together with the middle contacts 32 and 33 are made in strips in each case and have the corresponding insulator blocks 25, 26 and 27 respectively molded around them. The contact carrier 27 is placed on one end of the yoke or pole plate 23, or the end of permanent magnet 21 if pole plates are not used, (in the direction of arrow 34), while contact carriers 25 and 26 are located from below (arrow 35) and from above (arrow 36) respectively on the end of the other yoke or pole plate 22 or the other end of the permanent magnet 21. In the process of assembling carriers 25 and 26 the pegs 37 of the contact carrier 26 are pressed into holes 38 of contact carrier 25 and then distorted using heat. To improve the lock the yoke or pole plate 22 also has recesses 39 in which the pegs 37 are received.

To mount the armature 44 the contact carrier 37 is fitted with fork-like projections 40 and 41 which extend on both sides of the permanent magnet 21 and provide bearing bushes 42 and 43 respectively for bearing lugs 45 and 46 molded to the armature 44. To engage the bearing lugs 45 and 46 the projections 40 and 41 can be pressed out elastically in the direction of arrows 47 and 48 respectively.

Figure 3:
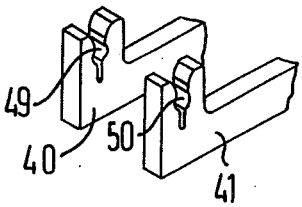
FIG. 3 is a fragmentary perspective view of a modification of the armature supporting yoke of FIG. 2.

FIG. 3 shows a somewhat modified embodiment of this detail. Here the projections 40 and 41 are in each case fitted with laterally slotted bearing bushes 49 and 50 respectively so that the armature can be snapped in at right angles to the axis of the bearings.

Figure 4:
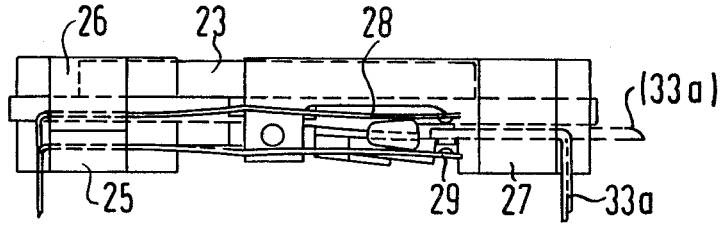
FIG. 4 is a side plan view of the assembled magnet, armature and contact carrier assembly of the relay of FIG. 2.

To operate the contacts the armature carries an actuating plate 51 housing lateral arms 52 which support actuating elements 53 made of insulating material in each case. Soldering pin connectors 28*a* to 31*a*, in the form of projections on the contact springs 28 to 31, are bent at right angles on the outside of the contact carriers 25 and 26. In contrast the soldering pin connectors 32*a* and 33*a* of the middle contacts 32 and 33 are left straight during assembly so as to allow the magnet and contact unit to be inserted into the coil tube parallel with its axis. After assembly they are also bent at right angles towards the connection side of the relay. FIG. 4 shows the finished insertion unit of FIG. 2 viewed from the side.

Figure 5:
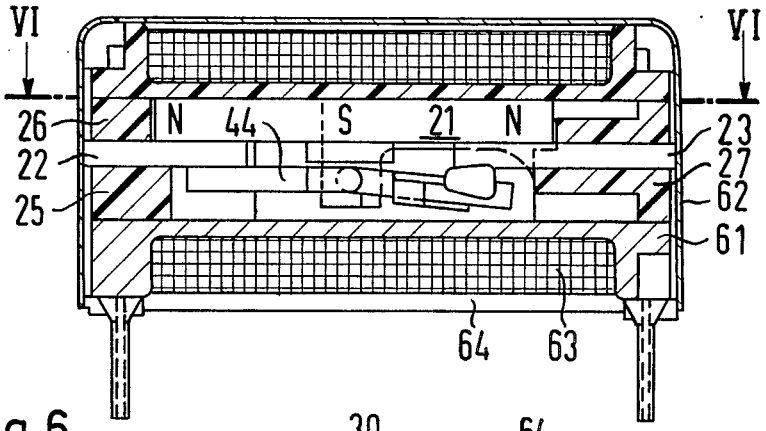
FIG. 5 is a view similar to FIG. 4 illustrating the relay in assembled condition and is a cross-section taken along the lines V—V of FIG. 6.
Figure 6:
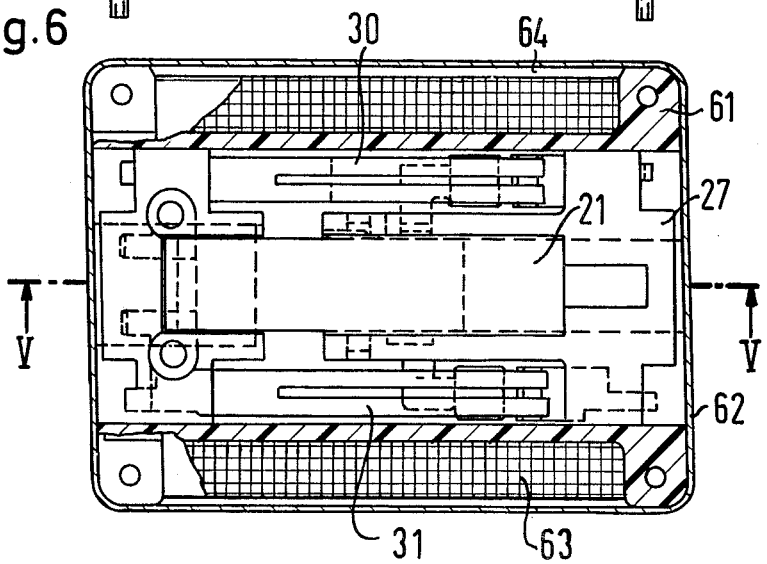
FIG. 6 is a cross-section view taken along the lines VI—VI of FIG. 5.

FIGS. 5 and 6 show two sectional views of a complete relay in accordance with the invention with a polarized magnet system and two sets of reversing springs. A magnet and contact unit as in FIGS. 2 and 4 is inserted in the body 61 of the coil, the switching space is sealed at the ends by the contact carriers 25, 26 and 27 and the pole plates 22 and 23. A soft magnetic cap 62 is fitted closely over the entire relay and the interspace between the coil body 61 or the winding 63 and the cap 62 is filled with casting compound 64. The switching space, interior of the coil is already so well sealed by the contact carriers 25, 26 and 27 that no casting compound can get inside.

Figure 7:
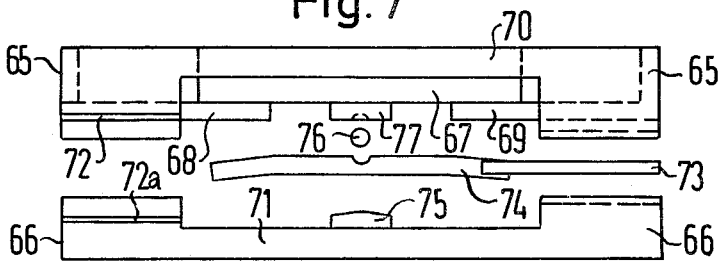
FIG. 7 is a exploded view similar to FIG. 4 of a modification of the sub-assembly of this invention.

In certain circumstances it may be more advantageous from a production viewpoint to only use two contact carrier parts 65 and 66 as shown diagrammatically in FIG. 7 in place of the three contact carriers 25, 26 and 27. These contact carriers 65 and 66 could embrace the rigid rail made from bar magnet 67 and two pole plates 68, 69 at both ends from above and below and have their respective middle parts 70 and 71 running parallel with the permanent magnet 67. Since the contact carriers play no part in the strength of the entire system, these middle parts 70 and 71 can be made suitably thin so that they take up little space. The contact springs 72 and 72*a* are molded at one end in the carriers 65 and 66 in a manner known per se while the middle contact 73 is clamped at the other end between the two contact carriers. Furthermore FIG. 7 shows a diagrammatic representation of a modified armature mounting. Here the armature 74 is pressed against a bearing shaft 76 on the flux plate 77 by a supporting rib 75 on the contact carrier 66.

Figure 8:
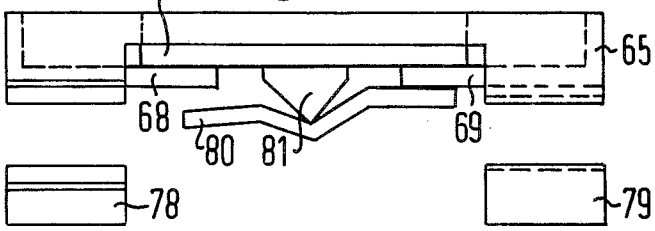
FIG. 8 is a view similar to FIG. 7 illustrating a further modification.

FIG. 8 shows another modification relative to FIG. 7. Here the contact carrier 65 is constituted as in FIG. 7 while the contact carrier 66 is replaced by two separate contact carriers 78 and 79 without any linking middle section which are otherwise attached as in FIG. 7 with the contact carrier 65 to the permanent magnet 67 and its pole plates 68 and 69. In addition a modified armature mounting is shown diagrammatically in which the armature 80 is mounted on a pole piece 81 with a roughly triangular cross-section.

It can therefore be seen from the above that this invention provides a miniature relay having a sub-assembly insertable into the hollow interior of the coil, the sub-assembly including a bar magnet with electrical contact carriers and a rotatable or pivotable armature attached thereto. The sub-assembly is preassemblable as a unit and thereafter insertable into the coil. The relay, when assembled, is capable of being thereafter magnetized and balanced.

Although the teachings of our invention have herein been discussed with reference to specific theories and embodiments, it is to be understood that these are by way of illustration only and that others may wish to utilize our invention in different designs or applications.

We claim as our invention:

1. In a polarized miniature relay having a switching space positioned interior of the body of a coil winding with a movable armature in the switching space adapted to operate at least one contact spring unit, the improvement of a bar permanent magnet positioned in the switching interior of the coil winding space parallel with the coil axis and extending longitudinally thereof, the bar magnet being insertable into the switching space axially of the coil, the bar magnet forming a rigid nonrotating member to which at least one contact carrier is affixed, and the armature being operatively carried by the bar magnet and rotatable relative thereto.

2. A relay according to claim 1 wherein the bar magnet has pole plates attached to axial ends thereof, the pole plates lying flat against end sections of the bar magnet and being welded thereto.

3. A relay as set forth in claim 2 wherein the permanent magnet is formed of a magnetic alloy containing cobalt, chromium, iron, and a small amount of silicon.

4. The relay of claim 2 wherein the bar magnet has a flux plate attached thereto intermediate the pole plates, the flux plate effective to feed magnet flux to the armature, the armature positioned in juxtaposition to the middle pole of the bar magnet, the bar magnet being a three-pole magnet.

5. A relay according to claim 1 wherein the contact carrier is attached to the magnet in an assembly locking manner.

6. A relay according to claim 1 wherein two contact carrier assemblies are provided, one of said carriers being provided with projections extending along the permanent magnet on opposite sides thereof, the projections providing a mounting member for the armature, the one contact carrier being attached to and carried by the bar magnet.

7. The relay of claim 6 wherein the projections are provided with bearing bushes, the projections being elastically spreadable to receive bearing lugs formed on the armature in the bushes.

8. The relay of claim 6 wherein the projections are provided with slotted bearing bushings, the bearing bushings being elastically spreadable to receive and retain bearing lugs formed on the armature.

9. A relay according to claim 5 wherein two contact carriers are provided attached to the bar magnet, one of said contact carriers is constructed of two portions, each of which carries at least one contact spring projecting therefrom, the portions being attachable to one another in a locked position enclosing an end portion of one of the permanent magnet and a pole plate affixed to the permanent magnet adjacent an end thereof.

10. A relay according to claim 9 wherein one of the contact carrier portions is provided with integral projections and the other of the contact carrier portions is provided with integral openings dimensioned for receipt of the projections, the projections being lockable in said openings.

11. A relay according to claim 1 wherein a spring contact carrier is provided attached to the bar magnet, the spring contact carrier having contact springs anchored therein, the springs projecting therefrom laterally adjacent the permanent bar magnet substantially parallel with the coil axis.

12. A relay according to claim 11 wherein the armature has at least one actuating arm projecting therefrom disposed adjacent the contact springs and contactable therewith, the actuating arm being bendable to provide for actuating adjustment.

13. In a polarized miniature relay having a switching space positioned interior of the body of a coil winding with a movable armature in the switching space adapted to operate at least one contact spring unit, the improvement of a bar permanent magnet positioned in the switching space parallel with the coil axis, the bar magnet being insertable into the switching space axially of the coil, the bar magnet forming a rigid member to which at least one contact carrier is affixed, and the armature being operatively carried by the bar magnet wherein the contact carrier and movable armature are attachable to the permanent magnet in an assembly locking manner providing an independent sub-assembly consisting of the relay bar magnet, armature and electrical contact members, the sub-assembly being insertable axially into the body of the coil winding interior thereof as a completed sub-assembly.

14. A relay according to claim 13 wherein at least two contact carriers are provided, one adjacent each end of the bar magnet the contact carriers closing axial end openings of the coil body upon insertion of the sub-assembly into the coil body.

15. A relay according to claim 13 wherein at least one of the contact carriers is provided with projecting contact members having contact pins extending from the contact carrier outwardly therefrom to project exterior of the coil winding upon insertion of the sub-assembly into the coil body, the pins projecting axially whereby the sub-assembly is insertable into the coil body, the pins being bendable to position overlying radial portions of the coil body lying radial outwardly of the switching space.

16. A relay according to claim 14 wherein the permanent magnet has pole plates attached thereto adjacent its ends, the pole plates projecting exterior of the switching space, a ferromagnetic protective cap received over said relay and having wall portions overlying the switching space at axial ends of the coil body, the pole plates contacting surface portions of said wall portions providing a return path for magnetic flux.

17. An electric relay comprising a coil body having a coil winding therearound, the body having a hollow interior defining a switching space, a switching sub-assembly received in said switching space, said sub-assembly including a substantially rigid elongated permanent bar magnet, contact carriers affixed to said bar magnet adjacent opposite ends thereof, one of said contact carriers having projecting contact springs extending therefrom, the projecting contact springs extending parallel to said bar magnet laterally adjacent thereto. a pivotable armature carried by said sub-assembly in opposition to said bar magnet pivotable to actuate said contact springs by contact therewith, and said sub-assembly being assembled as a separate locked together structure insertable into the switching space axially of the coil body.

18. The relay of claim 17 wherein the contact carriers at opposite ends of the bar magnet close axial open ends of the switching space upon insertion of the sub-assembly into the coil body.

19. The relay of claim 18 wherein the armature is pivotably carried by one of said contact carriers.

20. The relay of claim 19 wherein a magnetic non-insulating protective cap is received over the relay and is in magnetic flux communicating connection with the bar magnet through members projecting through the contact carriers and attached to the bar magnet.

* * * * *